United States Patent [19]

Coletti

[11] 4,445,493

[45] May 1, 1984

[54] DISTRIBUTOR WITH REDUCED RADIO FREQUENCY INTERFERENCE

[75] Inventor: Onorio J. Coletti, Roseville, Mich.

[73] Assignee: Ford Motor Company, Dearborn, Mich.

[21] Appl. No.: 327,008

[22] Filed: Dec. 3, 1981

[51] Int. Cl.[3] ..... H01H 19/00; F02P 1/00

[52] U.S. Cl. ..... 123/633; 123/146.5 A; 123/407; 200/19 R

[58] Field of Search ..... 123/146.5 A, 633, 407; 200/19 R, 19 DC

[56] References Cited

U.S. PATENT DOCUMENTS

| | | | |
|---|---|---|---|
| 2,149,516 | 3/1939 | Flamm | 123/146.5 A X |
| 2,207,368 | 7/1940 | Arthur | 123/633 X |
| 2,790,020 | 4/1957 | Redick et al. . | |
| 2,947,297 | 8/1960 | Kittler et al. . | |
| 2,987,587 | 6/1961 | Estes | 200/19 |
| 3,139,079 | 6/1964 | Bettoni . | |
| 3,441,690 | 4/1969 | Tibbs | 200/19 DC |
| 3,542,006 | 11/1970 | Dusenberry | 123/146.5 A |
| 3,600,530 | 8/1971 | Dusenberry | 200/19 |
| 4,039,787 | 8/1977 | Hori et al. | 123/146.5 R X |
| 4,077,378 | 3/1978 | Okumura | 200/19 DC X |

FOREIGN PATENT DOCUMENTS

| | | | |
|---|---|---|---|
| 45-19044 | 8/1969 | Japan | 123/146.5 A |
| 55-75571 | 6/1980 | Japan | 123/146.5 A |

*Primary Examiner*—Parshotam S. Lall
*Assistant Examiner*—W. R. Wolfe
*Attorney, Agent, or Firm*—Peter Abolins; Robert D. Sanborn

[57] ABSTRACT

Intake manifold vacuum is used to reduce the internal absolute pressure within a distributor cap. The reduced pressure will reduce both the initial breakdown voltage and sustaining voltage required to support the rotor to cap gap arc, thereby reducing radio frequency interference.

1 Claim, 4 Drawing Figures

DISTRIBUTOR WITH REDUCED RADIO FREQUENCY INTERFERENCE

BACKGROUND OF THE INVENTION

1. Field of the Invention

This invention relates to distributors for spark ignited vehicle engines.

2. Prior Art

Radio noises generated by automobiles have caused interference to various types of communication equipment such as radios and televisions. The problem can be reduced by reducing the emission of such electromagnetic noise from the automobile. It has been known that the ignition distributor for automobiles is one of the main points where such noises generate. When a spark occurs between the rotor electrode and each of the stationary side electrodes, a jamming radio wave is emitted. However, no effective noise suppression device for the distributor has been developed yet. Among the known attempts to reduce noise has been the use of a resistor attached to an external terminal of the spark plug. A resistor can also be inserted in one position of the high tension cable. Further, a noise suppressing capacitor can be used.

Other attempts to reduce noise include shaping of the rotor to a sharp point so that arcing can occur with less emission of noise. It is also known to use silicon grease to reduce the electromagnetic emissions associated with arcing. Typically, the solutions have added to the cost of the distributor and have not provided a complete solution. These are some of the problems this invention overcomes.

U.S. Pat. No. 3,542,006 issued to Dusenberry et al discloses an RFI suppressing ignition system which combines a relatively large gap width between the rotating terminal and each stationary terminal with a television-radio radiation suppression ignition cable and resistor type spark plugs.

U.S. Pat. No. 3,600,530 also issued to Dusenberry et al provides an RFI shield comprising a generally cup-shaped metallic housing 130, 132 that is attached to the breaker plate of the distributor. The cup-shaped housing is formed in two complementary interfitting metallic parts shown in FIGS. 3, 4 and 5. The compartment defined by the breaker plate and the two housing shield parts encloses the distributor breaker contacts, a capacitor and a capacitor lead wire connecting a capacitor to one of the breaker contacts.

U.S. Pat. No. 4,039,787 issued to Hori et al discloses a distributor wherein there is provided a first discharging gap and a second discharging gap. The second discharging gap is closed to the first discharging gap and both of the first and second discharging are located between the electrodes of the distributor rotor and a stationary contact. The gap distance of the second discharging gap is shorter than the first discharging gap. It is believed that RFI due to the spark discharge between the rotor and the distributor cap contacts can be reduced by causing the discharge current to have a relatively large pulse width and relatively small current value.

SUMMARY OF THE INVENTION

In accordance with an embodiment of this invention, a vacuum hose is connected between the distributor cap and the intake manifold vacuum port. This utilizes the intake manifold vacuum to reduce the internal absolute pressure of the distributor cap. The reduced pressure will reduce both the initial breakdown voltage and sustaining voltage required to support the rotor to cap gap arc, thereby reducing radio frequency interference (RFI) emissions. Advantageously, the distributor cap is gasketed to prevent excessive vacuum losses. Also, an oil seal is advantageously installed in the distributor rotor shaft to provide a positive commutation cavity vacuum seal and to prevent oil ingestion from the crankcase. Further, the vacuum hose connection prevents ozone build-up within the distributor cap thus making the ignition system more reliable.

Although it is a conventional arrangement to use a vacuum hose from the intake manifold to a vacuum servo for rotating the breaker plate within a distributor for a spark advance, there is no reduction of the absolute pressure within the entire distributor cap and no reduction in RFI.

DETAILED DESCRIPTION OF THE INVENTION

Experimentation with distributors indicates that the distributor cap is a major source of radio frequency (RFI) noise. The distributor cap noise is the results of the electrical discharge required to break down the rotor to cap gap. In an electrical discharge, the RF noise level is proportional to the amplitude of the current source subsequent to break down. The amplitude of the current surge is proportional to the required breakdown voltage. The required breakdown voltage is proportional to the absolute pressure in the gap. A s a result, it is believed that the RF noise level is proportional to the absolute pressure in the rotor to cap gap. In accordance with an embodiment of this invention, the available manifold vacuum is used as a means of reducing the absolute pressure in the rotor-to-cap gap and therefore reduces RF distributor cap gap noise.

Figure 1:
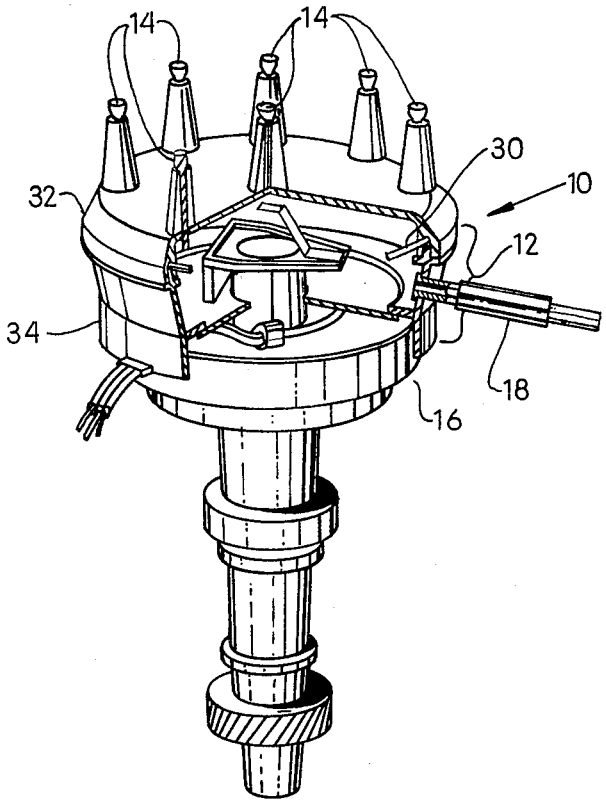
FIG. 1 is a perspective view of a partly broken away distributor in accordance with an embodiment of this invention.

Referring to FIG. 1, a distributor assembly 10 includes a distributor cap 12 positioned on a distributor 16. Distributor cap 12 has terminals 14 extending therefrom for connection to spark plugs. A vacuum hose 18 is coupled to distributor cap 12 at one end and to the intake manifold vacuum port 24. A vacuum is applied to an interior commutation cavity of distributor cap 12 by vacuum hose 18 and the magnitude of the vacuum applied to the commutation cavity is determined by the level of intake manifold vacuum. An O-ring gasket 30 seals the two portions of distributor cap 12, a terminal housing 32 and an adapter 34 to each other.

Figure 2:
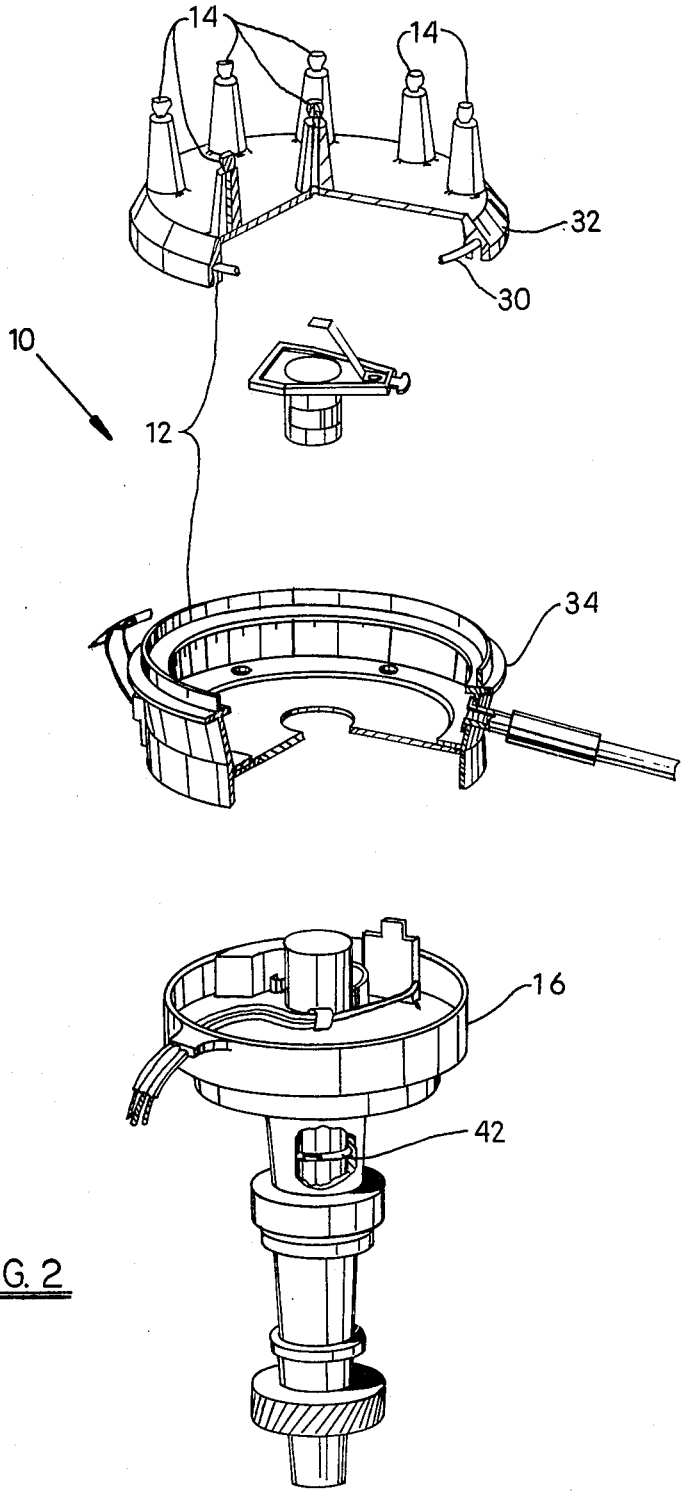
FIG. 2 is a perspective exploded view of a distributor in accordance with an embodiment of this invention.

Referring to FIG. 2, an oil seal 42 is installed on the distributor rotor shaft to provide a positive commutation cavity vacuum seal and to prevent oil ingestion from the crank case.

Figure 3A:
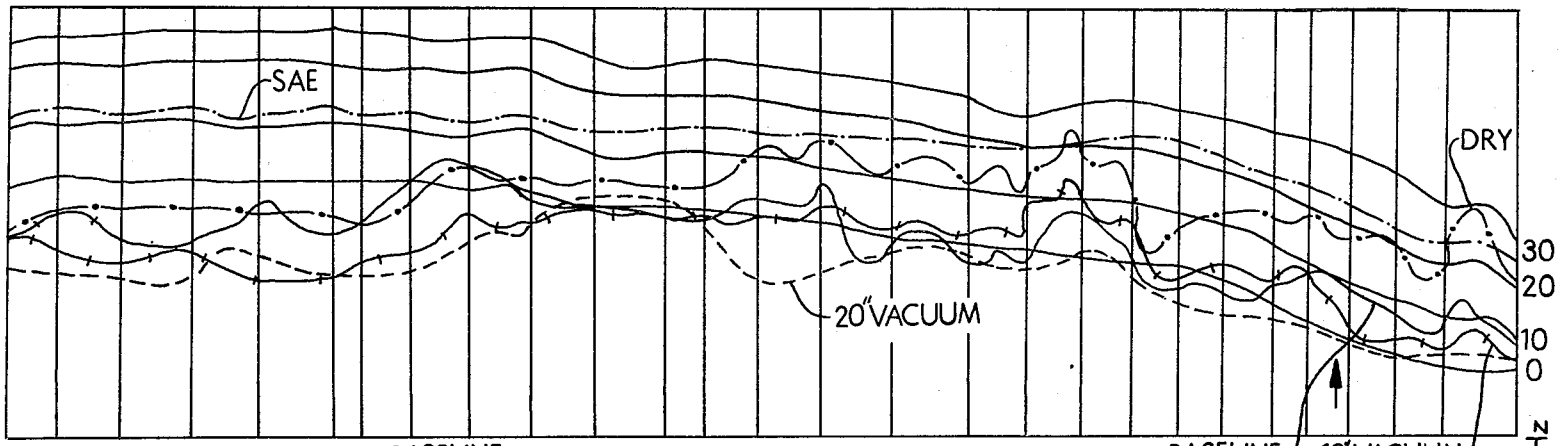
FIG. 3A is a graphical representation of field intensity NDB versus frequency MHZ for various distributors including base line, dry no vacuum, 10 inches vacuum drive and 20 inches vacuum drive.

FIG. 3A illustrates the RFI associated with: 1. a baseline distributor having no noise suppression 2. a distributor with an applied vacuum of 10 inches and 3 a distributor with an applied vacuum of 20 inches of mercury. The results indicate that 20 inches of vacuum is only slightly better than 10 inches. Further, 10 or 20 inches of vacuum is generally better than baseline.

Test results indicate that the reduced absolute pressure distributor cap RF noise is equal to or better than a distributor cap using silicon grease on the rotor blade. Further, the reduced absolute pressure distributor cap does not produce arc instability after breakdown like silicon grease and therefore does not generate static noise for FM reception on the vehicle entertainment radio. The reduced absolute pressure distributor increases the arc duration at the spark plug by 10–20%. This increased arc duration has been known to result in improved engine idle quality, improved vehicle emissions, and improved fuel economy.

Figure 3B:
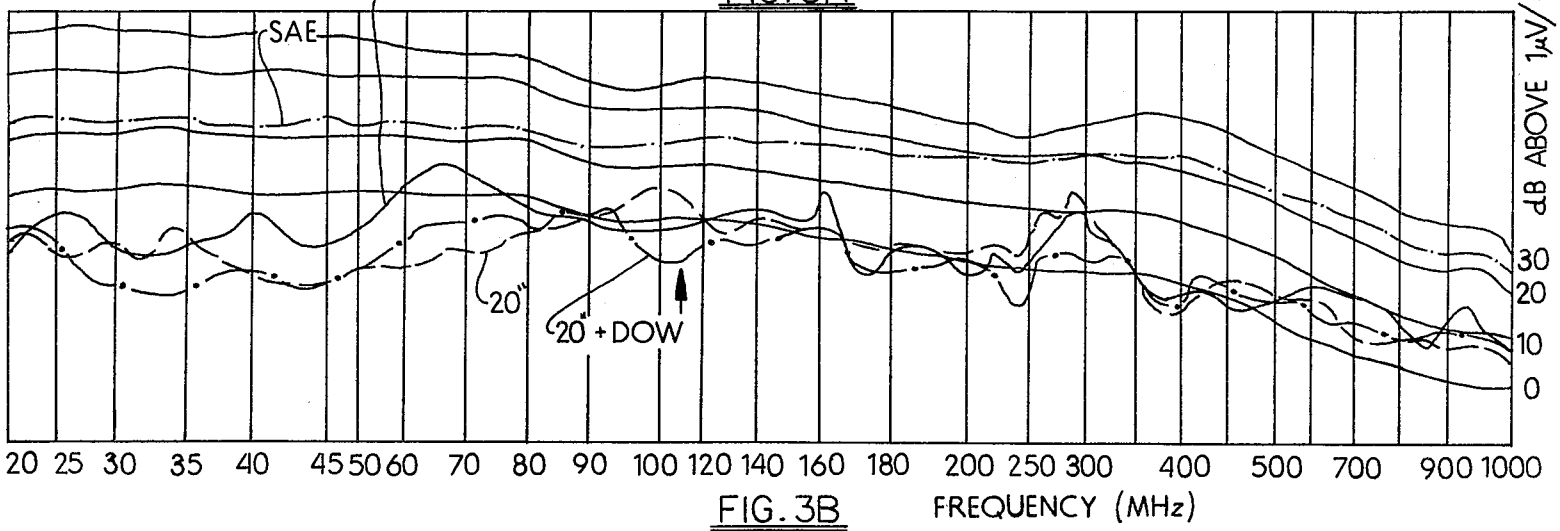
FIG. 3B is a graphical representation of field intensity NDB versus frequency MHZ for base line distributor and distributors with vacuum applied to ranges of mercury and vacuum with silicon grease.

Referring to FIG. 3B, there are shown graphs of electromagnetic field intensity versus frequency. It can be seen that the field intensity from the application of a vacuum magnitude of 20 inches of mercury is more than that when the 20 inches of mercury vacuum is combined with a silicon grease. As can be seen, the effect of vacuum and silicon grease is additive. Above the dotted and dashed lines is a combination dash- dot line which gives the Society of Automotive Engineers (SAE J-551) limit on permissible field intensity.

Various modifications and variations will no doubt occur to those skilled in the various arts to which this invention pertains. For example, the particular sealing of the distributor components may be varied from that disclosed herein. These and all other variations which basically rely on the teachings through which this disclosure has advanced the art are properly considered within the scope of this invention.

I claim:

1. A method for reducing radio frequency interference in an ignition distributor for use in a vehicle mounted internal combustion engine, including the steps of:

sealing an internal communtation cavity of the ignition distributor by applying a seal to a shaft coupling the engine to the distributor to provide a positive commutation cavity seal and to prevent ingestion of oil from the engine when vacuum is applied to the commutation cavity, and positioning an O-ring between components of the ignition distributor;

applying a vacuum source to the internal commutation cavity so as to reduce the pressure therein at least to a vacuum magnitude of 20 inches of mercury and reduce emissions of radio frequency interference during operation of the ignition distributor by connecting the internal commutation cavity to an intake manifold vacuum port of the engine; and applying silicon grease to the commutation cavity so as to provide a further additive reduction of radio frequency interference.

* * * * *